US007942704B2

(12) United States Patent
Ko et al.

(10) Patent No.: US 7,942,704 B2
(45) Date of Patent: May 17, 2011

(54) CROSSTALK-PROOF PLUG CONNECTOR

(75) Inventors: Wen-Chih Ko, Hsin-Tien (TW); Shu-Lin Duan, Hsin-Tien (TW); Ching-Tien Chen, Hsin-Tien (TW); Pin-Yuan Hou, Hsin-Tien (TW); Wei Wan, Hsin-Tien (TW)

(73) Assignee: Advanced Connectek Inc. (TW)

( * ) Notice: Subject to any disclaimer, the term of this patent is extended or adjusted under 35 U.S.C. 154(b) by 18 days.

(21) Appl. No.: 12/615,255

(22) Filed: Nov. 9, 2009

(65) Prior Publication Data

US 2011/0053414 A1 Mar. 3, 2011

(30) Foreign Application Priority Data

Aug. 31, 2009 (TW) ..... 98129217 A

(51) Int. Cl.
*H01R 24/00* (2006.01)
*H01R 33/00* (2006.01)

(52) U.S. Cl. ..... 439/660; 439/607.1

(58) Field of Classification Search ..... 439/638, 439/660, 218, 607.1, 607.54, 607.35, 607.04, 439/79
See application file for complete search history.

(56) References Cited

U.S. PATENT DOCUMENTS 7,794,284 B1 * 9/2010 He et al. ..... 439/660
7,806,735 B1 * 10/2010 Chen et al. ..... 439/676
7,862,346 B1 * 1/2011 Wan et al. ..... 439/79
7,862,378 B1 * 1/2011 Wan et al. ..... 439/607.35

* cited by examiner

*Primary Examiner* — Michael C Zarroli
(74) *Attorney, Agent, or Firm* — Hershkovitz & Associates, LLC; Abraham Hershkovitz

(57) ABSTRACT

A crosstalk-proof plug connector has an insulating housing, a mounting bracket, multiple first terminals, multiple second terminals and a shell. The first terminals are mounted on the insulating housing. The second terminals are mounted on the mounting bracket. Each terminal has a mounting section, a soldering section and a contacting section. The soldering sections are arranged in a transverse row with a specific sequence to prevent crosstalk interfering with signal transmission.

15 Claims, 10 Drawing Sheets

CROSSTALK-PROOF PLUG CONNECTOR

BACKGROUND OF THE INVENTION

1. Field of the Invention

The present invention relates to a connector, and more particularly to a crosstalk-proof plug connector preventing crosstalk and improving signal transmission stability.

2. Description of Related Art

Conventional Universal Serial Bus (USB) 2.0 connectors are popularly used in various electronic devices. However, USB 2.0 protocol only allows a maximum transmission speed of 480 Mbps. Because electronic devices are constantly developed to increase transmission speeds, the USB 2.0 protocol does not meet current transmission speed requirement of new electronic devices. Therefore, the USB Implementers Forum (USB IF) established USB 3.0 protocol, with a theoretical maximum transmission speed of 5 Gbps.

However, a USB 3.0 connector having two rows of terminals is structurally complicated so that manufacturing a USB 3.0 connector is difficult. Due to the rows of terminals and other constraints USB 3.0 connectors are generally longer and broader than USB 2.0 connectors. Furthermore, the terminals of the USB 3.0 connector generate crosstalk and interfere with each other when transmitting high frequency signals. Therefore, the USB 3.0 connector has a low production rate and a high manufacturing cost.

To overcome the shortcomings, the present invention provides a crosstalk-proof plug connector to mitigate or obviate the aforementioned problems.

SUMMARY OF THE INVENTION

The main objective of the invention is to provide a crosstalk-proof plug connector that prevents crosstalk and improves signal transmission stability.

A crosstalk-proof plug connector in accordance with the present invention has an insulating housing, a mounting bracket, multiple first terminals, multiple second terminals and a shell. The first terminals are mounted on the insulating housing. The second terminals are mounted on the mounting bracket. Each terminal has a mounting section, a soldering section and a contacting section. The soldering sections are arranged in a transverse row with a specific sequence to prevent crosstalk interfering with signal transmission.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
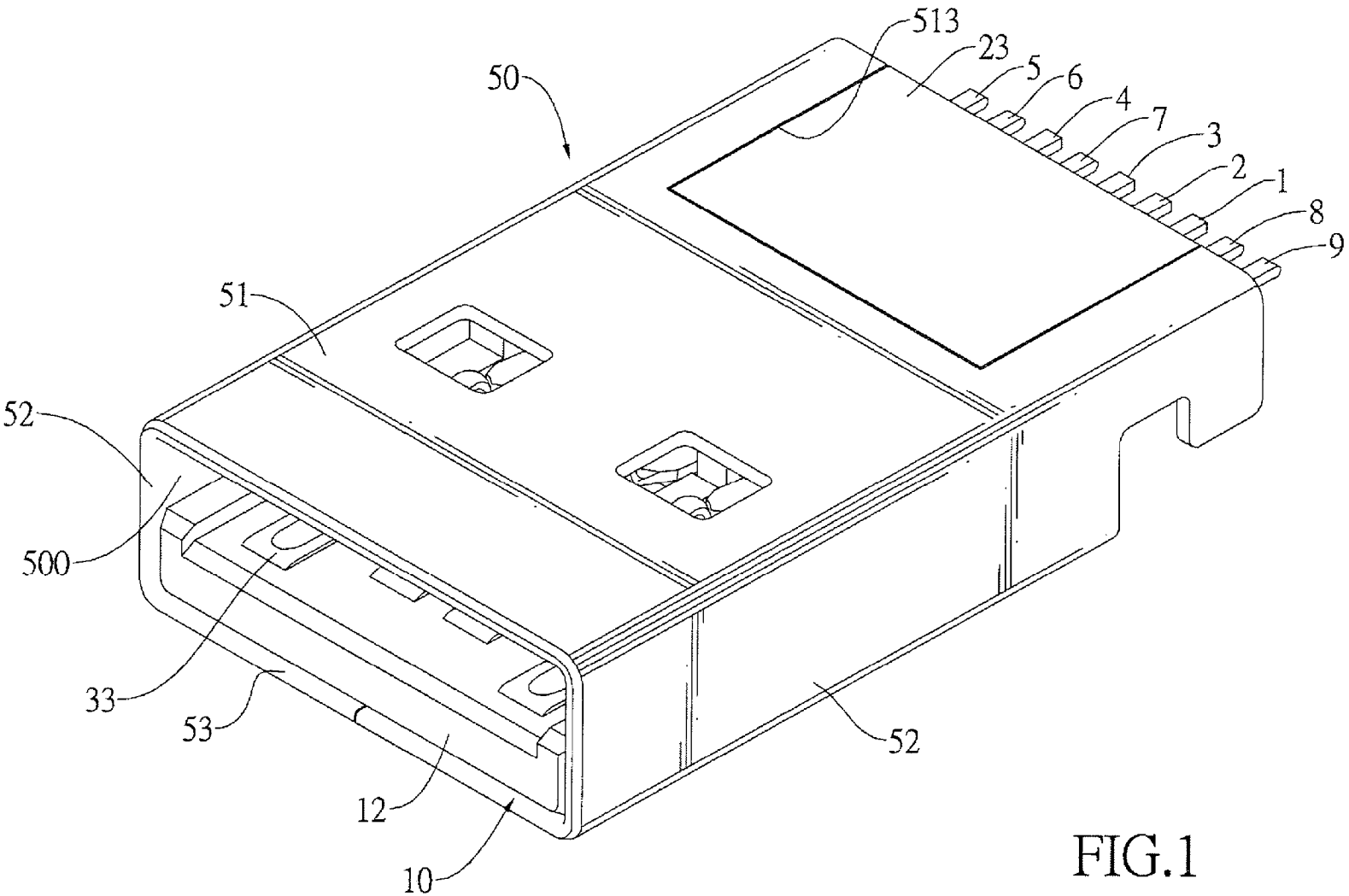
FIG. 1 is a front perspective view of a first embodiment of a crosstalk-proof plug connector in accordance with the present invention.
Figure 2:
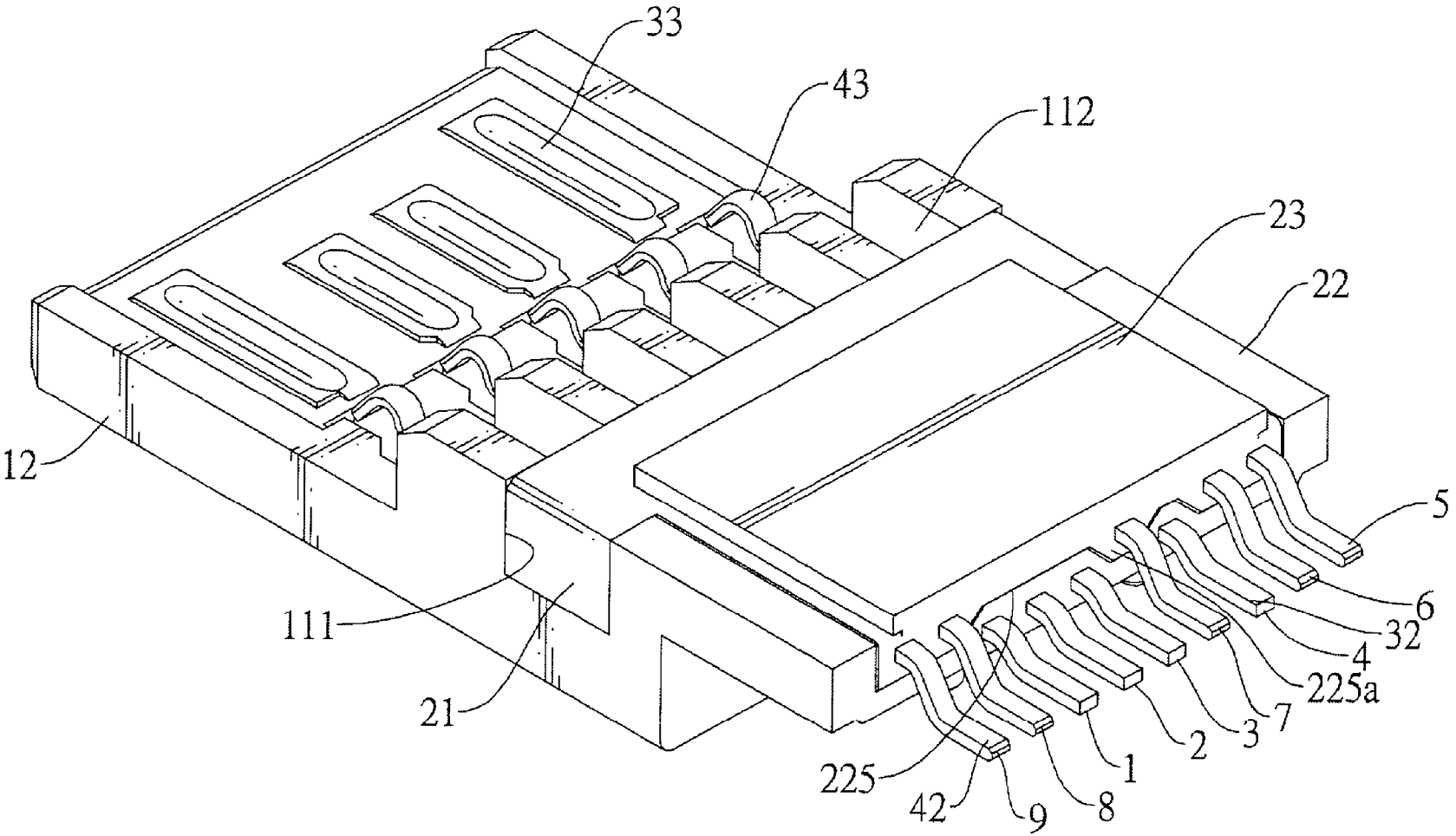
FIG. 2 is a rear perspective view of the crosstalk-proof plug connector in FIG. 1 omitting a shell thereof.
Figure 3:
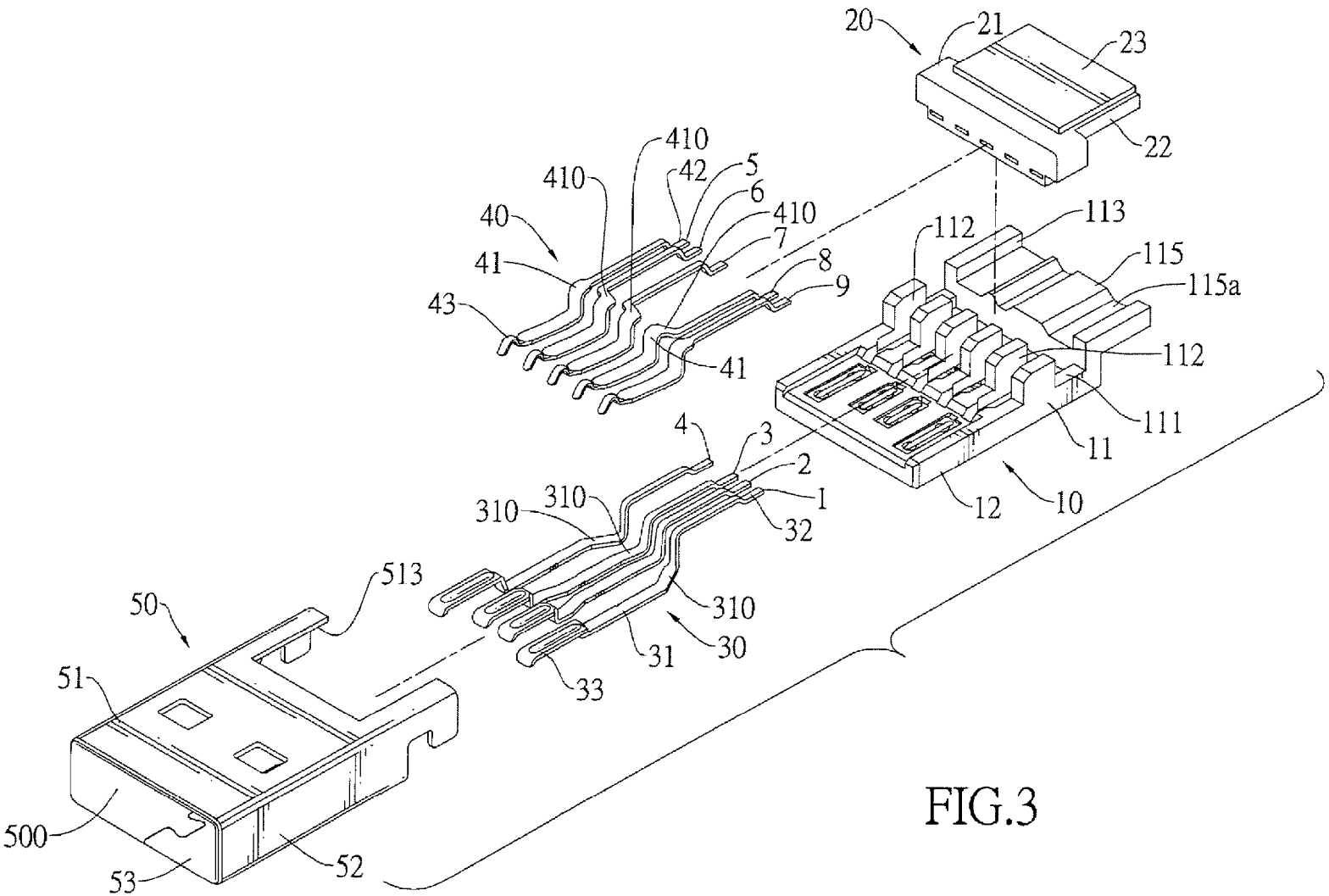
FIG. 3 is an exploded front perspective view of the crosstalk-proof plug connector in FIG. 1.
Figure 4:
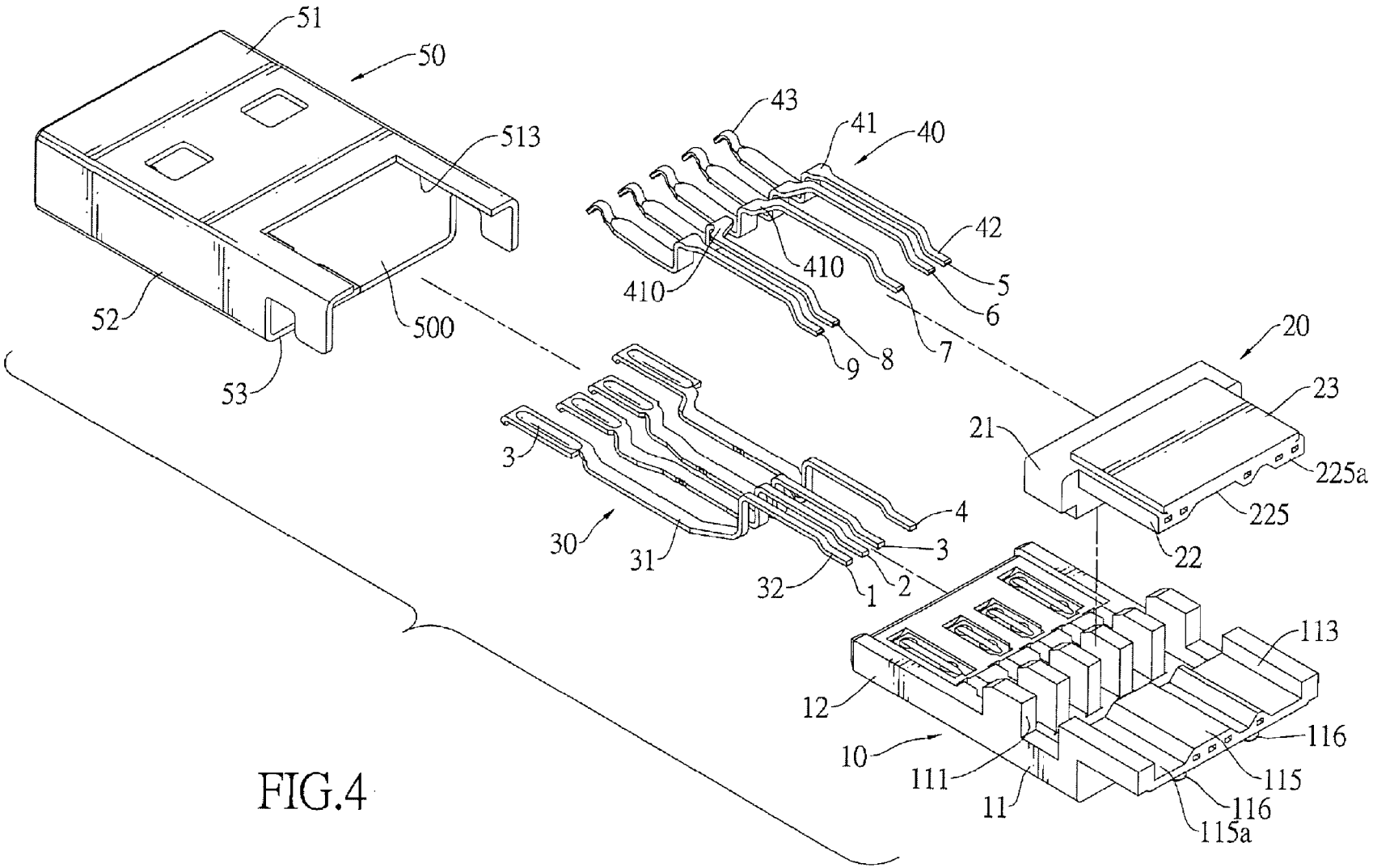
FIG. 4 is an exploded rear perspective view of the crosstalk-proof plug connector in FIG. 1.

With reference to FIGS. 1 to 4, a first embodiment of a crosstalk-proof plug connector accordance with the present invention may comply with type-A USB 3.0 plug connector standards and may be mounted on one end of a cable or in a portable device such as a flash memory storage device.

The crosstalk-proof plug connector of the first embodiment is a surface mount technology (SMT) type crosstalk-proof plug connector and comprises an insulating housing (10), a mounting bracket (20), multiple first terminals (30), multiple second terminals (40) and a shell (50).

Figure 5:
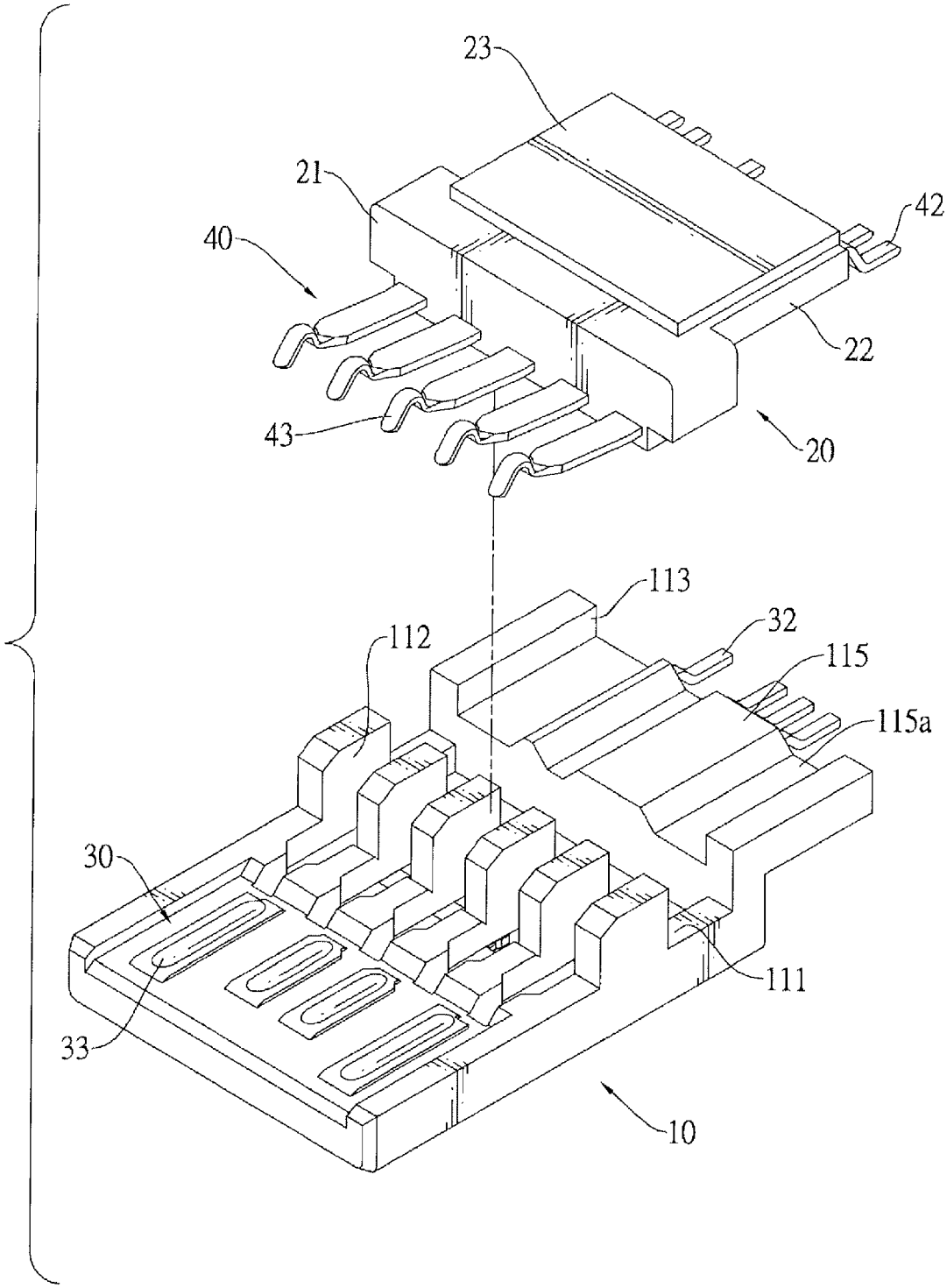
FIG. 5 is an enlarged and partially exploded perspective view of an insulating housing, mounting bracket and first and second terminals of the crosstalk-proof plug connector in FIG. 1.

With further reference to FIG. 5, the insulating housing (10) has a front end, a rear end, a base (11) and a tongue (12).

The base (11) has a front end, a rear end, a top and a bottom and may further have a fastening slot (111), a positioning slot (113), multiple first engaging elements, multiple positioning grooves (112) and multiple assembling protrusions (116). The fastening slot (111) is defined in the base (11). The positioning slot (113) is defined in the base (11) behind the fastening slot (111) and has an inner top surface. The first engaging elements are formed on the inner top surface and may be multiple teeth (115) and multiple keyways (115*a*) arranged alternately. The positioning grooves (112) are defined in the top of the base (11). The assembling protrusions (116) are formed on and protrude downward from the bottom and may be mounted through assembling holes in a printed circuit board or a bracket in the aforementioned cable or portable device.

The tongue (12) is formed on and protrudes forward from the front end of the base (11) and has a top and a bottom.

The mounting bracket (20) is a separate component from the insulating housing (10), is mounted on the insulating housing (10) and has a mount (21) and an extension member (22).

The mount (21) may be mounted in the fastening slot (111) of the insulating housing (10).

The extension member (22) is formed on and protrudes backward from the mount (21), may be mounted in the positioning slot (113) of the insulating housing (10) and may have a top surface, a bottom surface, a rear end, multiple second engaging elements and a mounting protrusion (23). The second engaging elements are formed on the bottom surface, respectively engage the first engaging elements and may be multiple keyways (225) and multiple teeth (225*a*) arranged alternately and respectively engaging the teeth (11) and keyways (115*a*) of the insulating housing (10). The mounting protrusion (23) is formed on and protrudes from the top surface.

The first terminals (30) are mounted through the insulating housing (10) by an insert-molding process and are capable of implementing USB 2.0 signal transmission. Each first terminal (30) has a mounting section (31), a soldering section (32) and a contacting section (33).

The mounting section (31) is mounted securely in the insulating housing (10).

The soldering section (32) is formed on and protrudes downward from the mounting section (31) and out of the rear end of the base (11).

The contacting section (33) is formed on and protrudes forward from the mounting section (31) and may be mounted on the top of the tongue (12).

The second terminals (40) are mounted through the mounting bracket (20) by an insert-molding process, are capable of cooperating with the first terminals (30) to implement USB 3.0 signal transmission and may be mounted respectively in the positioning grooves (112) to prevent inadvertent transverse shift. Each second terminal (40) has a mounting section (41), a soldering section (42) and a contacting section (43).

The mounting section (41) is mounted securely in the mounting bracket (20).

The soldering section (42) is formed on and protrudes downward from the mounting section (42) and out of the rear end of the extension member (22).

The contacting section (43) is formed on and protrudes forward from the soldering section (42) and is located above the tongue (12) of the insulating housing (10).

The shell (50) covers the insulating housing (10), the mounting bracket (20), the first terminals (30) and the second terminals (40), has a cavity (500) and may further have a front end, a rear end, a top plate (51), two side plates (52), a bottom plate (53) and an open slot (513).

The cavity (500) is defined through the shell (50) and may hold a tongue of a corresponding socket connector.

The top plate (51) has a rear end.

The side plates (52) are formed on and protrude downward from the top plate (51).

The bottom plate (53) is formed between the side plates (52).

The open slot (513) is defined in the top plate (51) adjacent to the rear end and holds the mounting protrusion (23) of the mounting bracket (20).

In one of important aspects of the present invention, the first terminals (30) include a pair of USB 2.0 signal terminals and at least one non-signal-transmission terminal (such as power terminals and grounding terminals). The second terminals (40) include at least one pair of signal receiving terminals, at least one pair of signal transmitting terminals and at least one non-signal-transmission terminal (such as power terminals and grounding terminals). The soldering sections (32, 42) of all of the first and second terminals (30, 40) are arranged in a transverse row relative to the insulating housing (10). The soldering section (32) of the at least one non-signal-transmission terminal of the first terminals (30) is located between the soldering sections (42) of one pair of the signal transmitting terminals and the soldering sections (32) of the pair of the USB 2.0 signal terminals. The soldering section (32, 42) of the at least one non-signal-transmission terminal of the first or second terminals (30, 40) is located between the soldering sections (42) of one pair of the signal receiving terminals and the soldering sections (32) of the pair of the USB 2.0 signal terminals.

In a preferred embodiment of the crosstalk-proof plug connector, the first terminals (30) are numbered as No. 5, 6, 7, 8 and 9 terminals (5, 6, 7, 8, 9) that are defined respectively as a super-speed negative signal receiving terminals (the aforementioned signal receiving terminal), a super-speed positive signal receiving terminal (the aforementioned signal receiving terminal), a signal-return-grounding terminal (the aforementioned grounding terminal), a super-speed negative signal transmitting terminal (the aforementioned signal transmitting terminal) and a super-speed positive signal transmitting terminal (the aforementioned signal transmitting terminal).

The second terminals (40) are numbered as No. 4, 3, 2 and 1 terminals (4, 3, 2, 1) that are defined respectively as a power-return-grounding terminal (the aforementioned grounding terminal), a positive signal terminal (the aforementioned USB 2.0 signal terminal), a negative signal terminal (the aforementioned USB 2.0 signal terminal) and a power terminal. The soldering sections (32, 42) of all terminals (30, 40) in the transverse row are arranged according to a sequence of No. 5, 6, 4, 7, 3, 2, 1, 8 and 9 terminals (5, 6, 4, 7, 3, 2, 1, 8, 9) from a left side to a right side of the crosstalk-proof plug connector.

The following Table A is based on Section 5.3.1.2 of "USB 3.0 Specification, Revision 1.0" set forth by the USB IF. The Specification may be downloaded from the USB IF website: http://www.usb.org/home.

TABLE A

Crosstalk-Proof Connector Terminal Assignment

| Terminal Number | Name | Assignment | Description |
|---|---|---|---|
| No. 5 terminal (5) | StdA_SSRx− | Super-speed negative signal receiving terminal | Super-speed receiver differential pair |
| No. 6 terminal (6) | StdA_SSRx+ | Super-speed positive signal receiving terminal | |
| No. 4 terminal (4) | GND | Power-return-grounding terminal | |
| No. 7 terminal (7) | GND_DRAIN | Signal return-grounding terminal | |
| No. 3 terminal (3) | D+ | Positive signal terminal | USB2.0 differential pair |
| No. 2 terminal (2) | D− | Negative signal terminal | |
| No. 1 terminal (1) | VBUS | Power terminal | |
| No. 8 terminal (8) | StdA_SSTx− | Super-speed negative signal transmitting terminal | Super-speed transmitter differential pair |
| No. 9 terminal (9) | StdA_Tx+ | Super-speed positive signal transmitting terminal | |

The definitions of the aforementioned first and second terminals (30, 40) are shown in Table A for clarity and convenience.

Figure 6A:
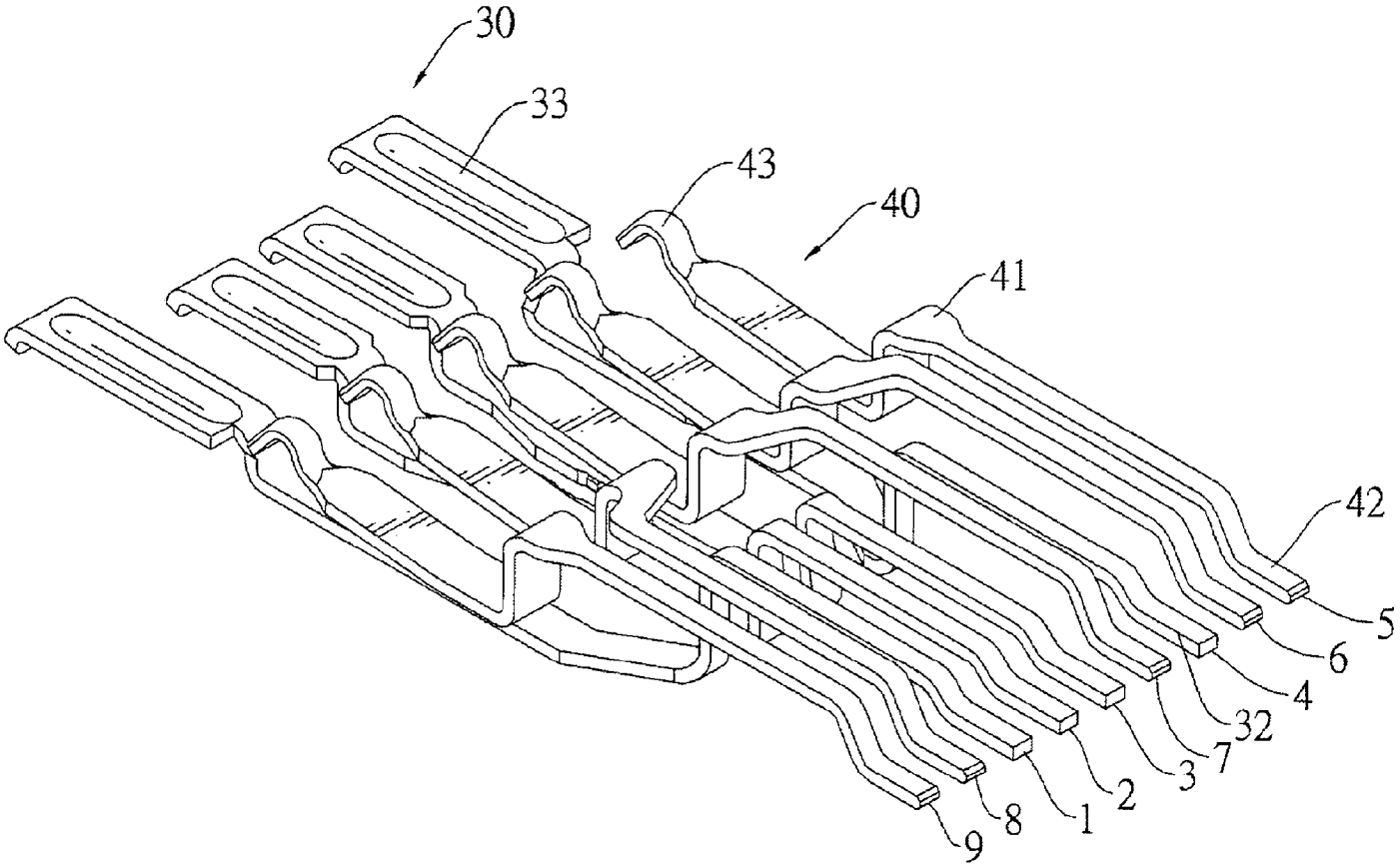
FIG. 6A is a perspective view of the first embodiment of the first and second terminals of the crosstalk-proof plug connector in FIG. 1.
Figure 7:
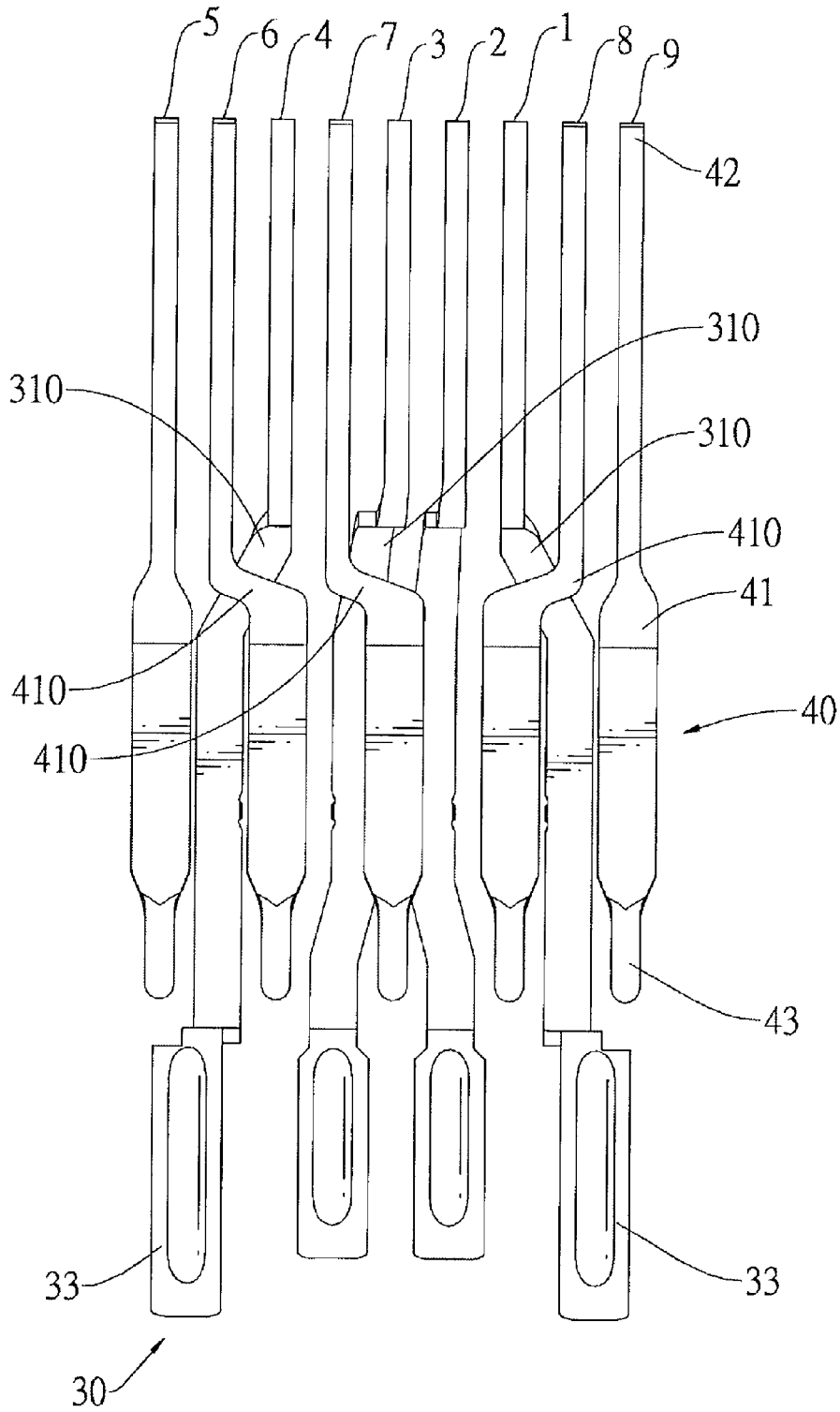
FIG. 7 is a top view of the first and second terminals of the crosstalk-proof plug connector in FIG. 6A.

With further reference to FIGS. 6A and 7, in a preferred embodiment of the crosstalk-proof plug connector, each mounting section (31) of No. 1, 3 and 4 terminals (1, 3, 4) of the first terminals (30) has a substantially Z-shaped bending segment (310). Each mounting section (41) of No. 6, 7 and 8 terminals (6, 7, 8) of the second terminals (40) has a substantially Z-shaped bending segment (410). No. 1 and 8 terminals (1, 8) intersect to form a substantially X-shaped configuration by the substantially Z-shaped bending segments (310, 410) of No. 1 and 8 terminals (1, 8). No. 4 and 6 terminals (4, 6) intersect to form a substantially X-shaped configuration by the substantially Z-shaped bending segments (310, 410) of No. 1 and 8 terminals (4, 6). The aforementioned transverse row arrangement of the soldering sections (32, 42) of all the first and second terminals (30, 40) is achieved through the X-shaped configurations.

With reference to FIG. 6A, in the first embodiment, the soldering sections (32, 42) of the first and second terminals (30, 40) are SMT type soldering sections and are L-shaped.

Figure 6B:
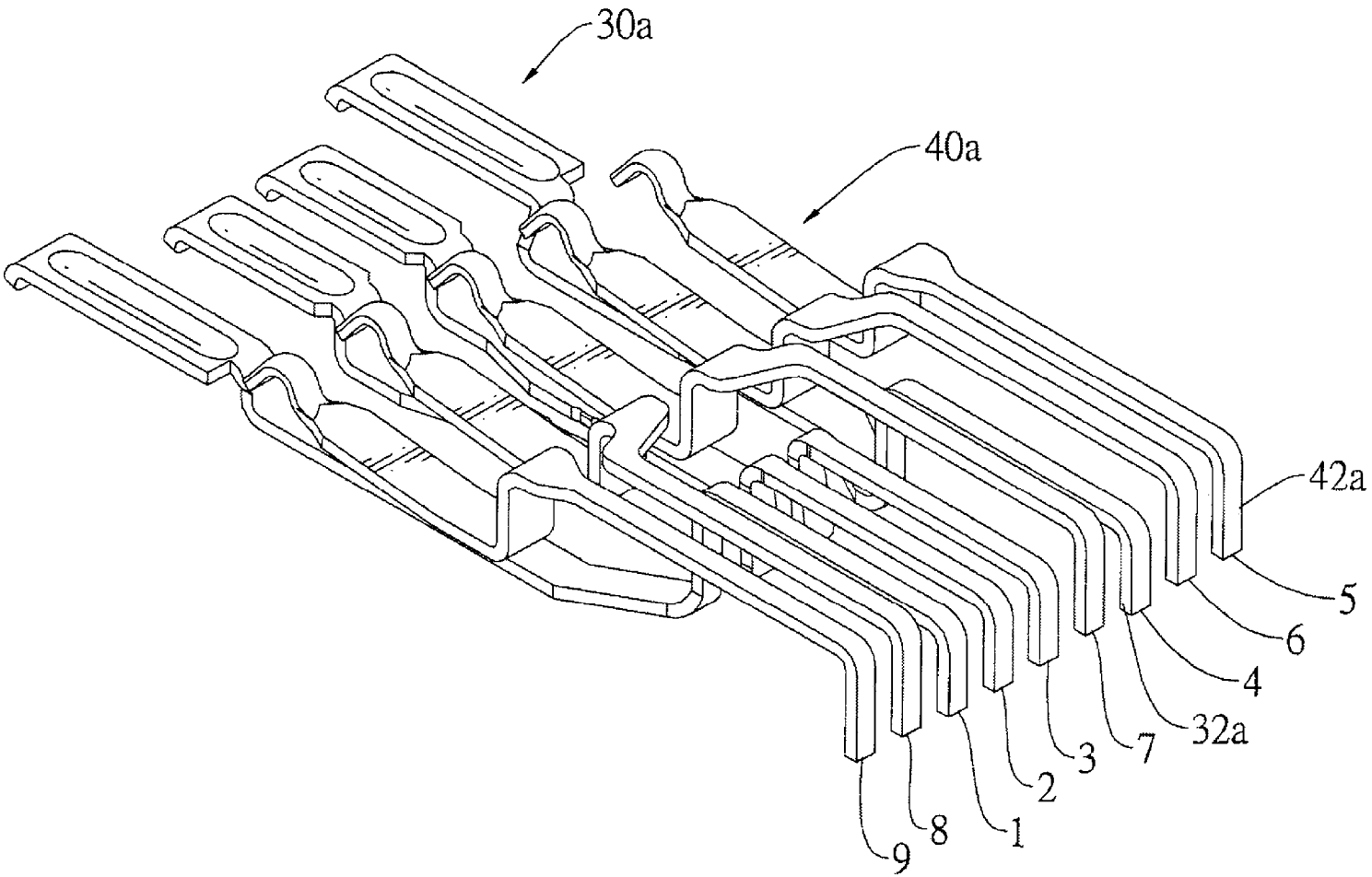
FIG. 6B is a perspective view of the first and second terminals of a second embodiment of the crosstalk-proof plug connector in accordance with the present invention.

With reference to FIG. 6B, a second embodiment of the crosstalk-proof plug connector is a through hole technology (THE) type crosstalk-proof plug connector. Therefore, the soldering sections (32*a*, 42*a*) of the first and second terminals (30*a*, 40*a*) are THE type soldering sections and are straight.

Figure 8:
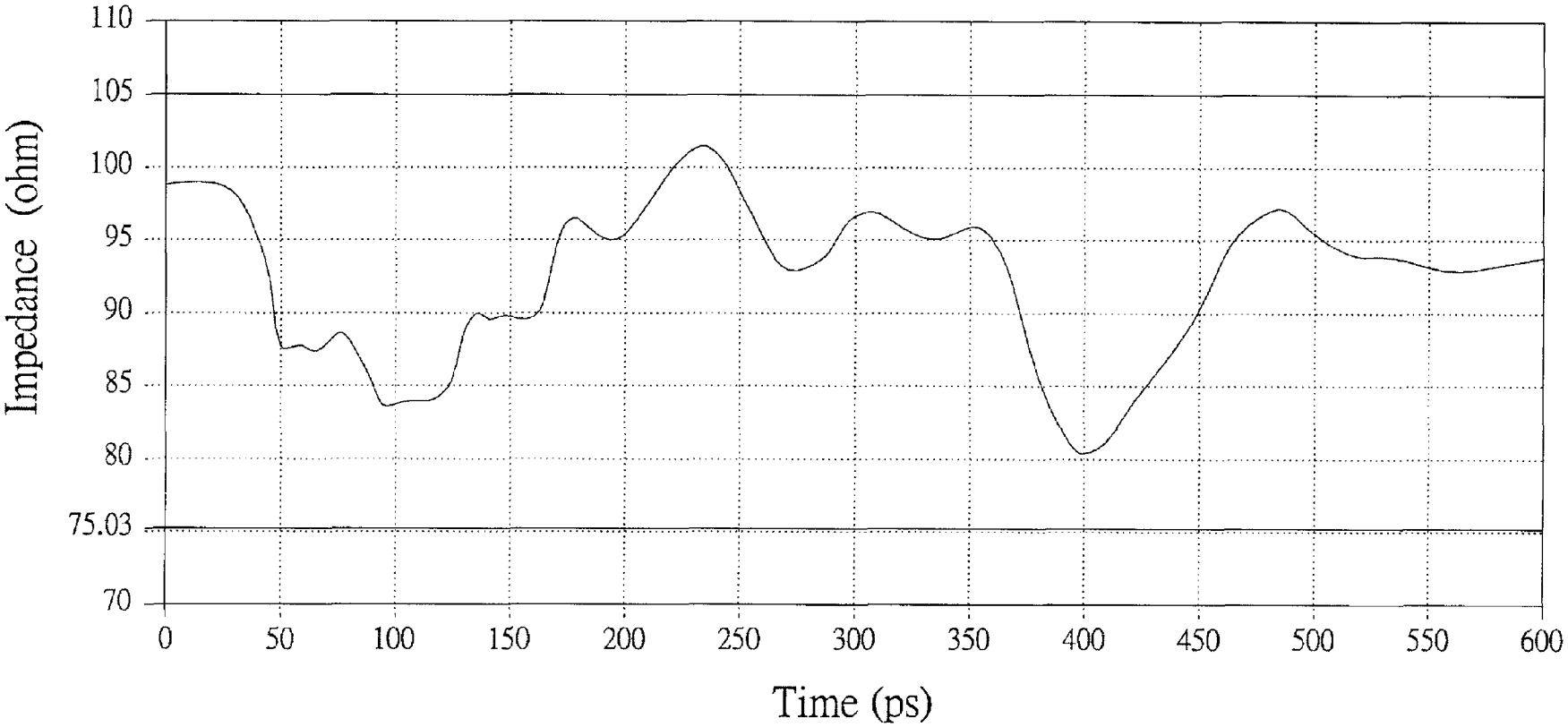
FIG. 8 is a diagram of impedance against time for the first embodiment of the crosstalk-proof plug connector in FIG. 1.

With further reference to FIG. 8, a diagram of impedance against time shows a curve indicating impedance of the SMT type crosstalk-proof plug connector of the first embodiment during signal transmission. The unit of the impedance is "ohm" and that of the time is "$10^{-12}$ second (Pico-second, ps)". As indicated by the curve, when signal transmission is implemented, maximum and minimum impedance values of the SMT type crosstalk-proof plug connector are 101.4 and 80.55 ohm and are within a limitation from 75 to 105 ohms of a standard USB 3.0 plug connector. Therefore, advantages of the SMT type crosstalk-proof plug connector include high frequency signal transmission.

Figure 9:
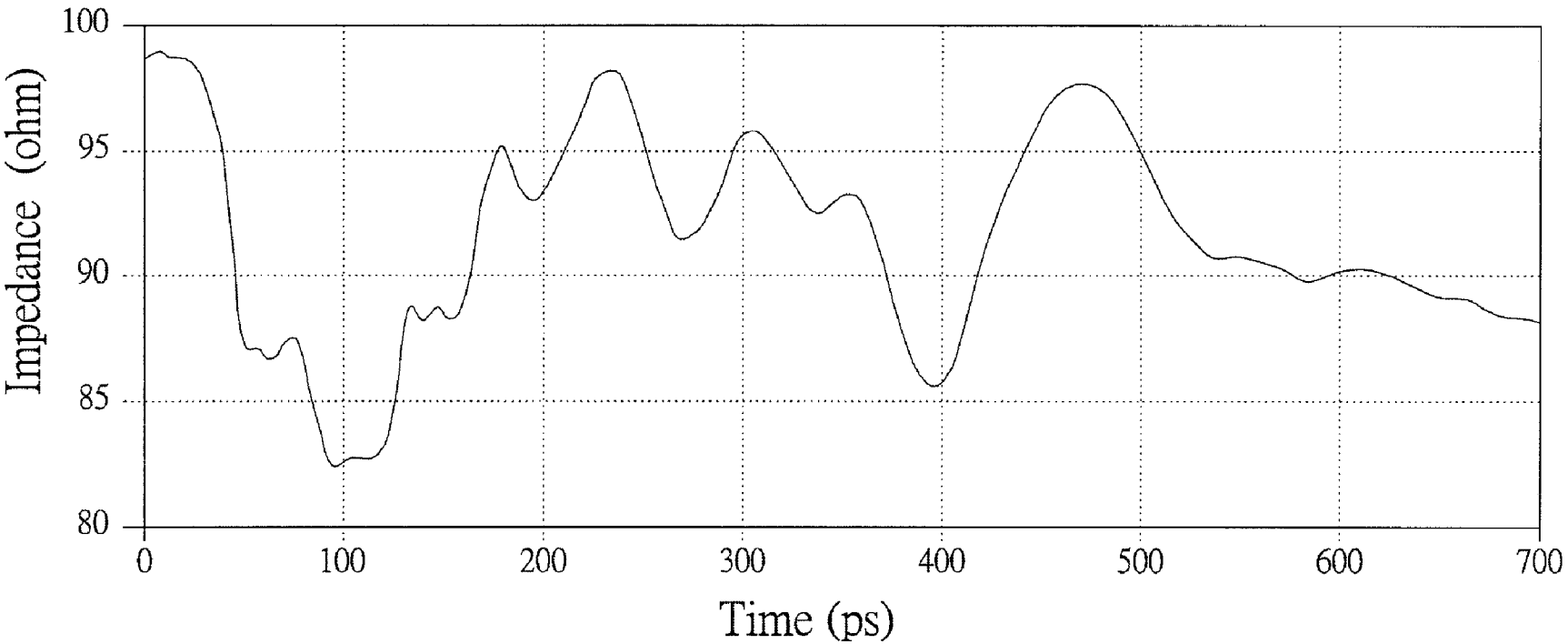
FIG. 9 is a diagram of impedance against time for the second embodiment of the crosstalk-proof plug connector in FIG. 6B.

With further reference to FIG. 9, a diagram of impedance against time shows a curve indicating impedance of the THE type crosstalk-proof plug connector of the second embodiment during signal transmission. As indicated by the curve, when signal transmission is implemented, maximum and minimum impedance values of the THE type crosstalk-proof plug connector are 98 and 82.5 ohm and are within the aforementioned standard limitation from 75 to 105 ohms. Therefore, advantages of the THE type crosstalk-proof plug connector include high frequency signal transmission.

The present invention has the following advantages:

1. The soldering sections (32, 32*a*, 42, 42*a*) of the non-signal-transmission terminal (1, 4, 7) are between adjacent pairs of the soldering sections (32, 32*a*, 42, 42*a*) of the signal transmitting or receiving terminals (2, 3, 5, 6, 8, 9) to prevent crosstalk and improve signal transmission stability.

2. The insulating housing (10) and mounting bracket (20) are separate components instead of being formed together so that designing and manufacturing a mold for each component is easy and cheap when compared to a structurally complicated mold for molding an one-piece insulating housing holding all terminals of a conventional connector. Thus, manufacturing costs of the crosstalk-proof plug connector are lowered.

3. The first and second engaging elements engaging each other quickly align and assemble the insulating housing (10) and the mounting bracket (20).

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A crosstalk-proof plug connector, comprising:

an insulating housing having a front end and a rear end;

a mounting bracket being a separate component relative to the insulating housing and mounted on the insulating housing;

multiple first terminals mounted through the insulating housing and each first terminal having a mounting section mounted securely in the insulating housing;

a soldering section formed on and protruding from the mounting section out of the rear end of the insulating housing; and a contacting section formed on and protruding from the mounting section;

multiple second terminals mounted through the mounting bracket and each second terminal having a mounting section mounted securely in the mounting bracket;

a soldering section formed on and protruding from the mounting section; and a contacting section formed on and protruding from the soldering section; and a shell covering the insulating housing, the mounting bracket, the first terminals and the second terminals and having a cavity defined through the shell, wherein the first terminals include a pair of USB 2.0 signal terminals and at least one non-signal-transmission terminal; the second terminals include at least one pair of signal receiving terminals, at least one pair of signal transmitting terminals and at least one non-signal-transmission terminal; the soldering sections of all of the first and second terminals are arranged in a transverse row relative to the insulating housing; the soldering section of at least one of the non-signal-transmission terminals is located between the soldering sections of one pair of the signal transmitting terminals and the soldering sections of the pair of the USB 2.0 signal terminals; and the soldering section of at least one non-signal-transmission terminal is located between the soldering sections of one pair of the signal receiving terminals and the soldering sections of the pair of the USB 2.0 signal terminals.

2. The crosstalk-proof plug connector as claimed in claim 1, wherein the first terminals are numbered as No. 5, 6, 7, 8 and 9 terminals that are defined respectively as a super-speed negative signal receiving terminal, a super-speed positive signal receiving terminal, a signal-return-grounding terminal, a super-speed negative signal transmitting terminal and a super-speed positive signal transmitting terminal;

the second terminals are numbered as No. 4, 3, 2 and 1 terminals that are defined respectively as a power-return-grounding terminal, a positive signal terminal, a negative signal terminal and a power terminal; and the soldering sections of all terminals in the transverse row are arranged according to a sequence of the No. 5, 6, 4, 7, 3, 2, 1, 8 and 9 terminals from a left side to a right side of the crosstalk-proof plug connector.

3. The crosstalk-proof plug connector as claimed in claim 2, wherein each mounting section of the No. 1, 3 and 4 terminals of the first terminals has a substantially Z-shaped bending segment;

each mounting section of the No. 6, 7 and 8 terminals of the second terminals has a substantially Z-shaped bending segment;

the No. 1 and 8 terminals intersect to form a substantially X-shaped configuration by the substantially Z-shaped bending segments of the No. 1 and 8 terminals; and the No. 4 and 6 terminals intersect to form a substantially X-shaped configuration by the substantially Z-shaped bending segments of the No. 1 and 8 terminals.

4. The crosstalk-proof plug connector as claimed in claim 3, wherein the crosstalk-proof plug connector complies with type-A USB 3.0 plug connector standards;

the first terminals are capable of USB 2.0 signal transmission; and the second terminals are capable of cooperating with the first terminals for USB 3.0 signal transmission.

5. The crosstalk-proof plug connector as claimed in claim 2, wherein the insulating housing further has a base having a front end, a rear end, a top and a bottom; and a tongue formed on and protruding forward from the front end of the base and having a top and a bottom;

the mounting bracket has a mount; and an extension member formed on and protruding backward from the mount and having a top surface, a bottom surface and a rear end;

the soldering sections of the first terminals protrude out of the rear end of the base and the contacting sections of the first terminals are mounted on the top of the tongue; and the soldering sections of the second terminals protrude out of the rear end of the extension member and the contacting sections of the second terminals are located above of the tongue of the insulating housing.

6. The crosstalk-proof plug connector as claimed in claim 5, wherein the base of the insulating housing further has a fastening slot defined in the base; and the mount of the mounting bracket is mounted in the fastening slot.

7. The crosstalk-proof plug connector as claimed in claim 5, wherein the base of the insulating housing further has a positioning slot defined the base behind the fastening slot and having an inner top surface; and the extension member of the mounting bracket is mounted in the positioning slot.

8. The crosstalk-proof plug connector as claimed in claim 7, wherein the base further has multiple first engaging elements formed on the inner top surface of the positioning slot; and the extension member further has multiple second engaging elements formed on the bottom surface and respectively engaging the first engaging elements.

9. The crosstalk-proof plug connector as claimed in claim 8, wherein the first engaging elements are multiple teeth and keyways arranged alternately; and the second engaging elements are multiple keyways and multiple teeth arranged alternately and respectively engaging the teeth and keyways of the insulating housing.

10. The crosstalk-proof plug connector as claimed in claim 5, wherein the extension member of the mounting bracket further has a mounting protrusion formed on and protruding from the top surface of the extension member; and the shell further has a front end, a rear end, a top plate, two side plates, a bottom plate and an open slot defined in the top plate adjacent to the rear end and holding the mounting protrusion.

11. The crosstalk-proof plug connector as claimed in claim 3, wherein the soldering sections of the first and second terminals are SMT type soldering sections and are L-shaped.

12. The crosstalk-proof plug connector as claimed in claim 3, wherein the soldering sections of the first and second terminals are THE type soldering sections and are straight.

13. The crosstalk-proof plug connector as claimed in claim 5, wherein the base of the insulating housing further has multiple assembling protrusions formed on and protruding downward form the bottom.

14. The crosstalk-proof plug connector as claimed in claim 5, wherein the first terminals are mounted on the insulating housing by an insert-molding process.

15. The crosstalk-proof plug connector as claimed in claim 5, wherein second terminals are mounted on the mounting bracket by an insert-molding process.

* * * * *